US007192009B2

(12) United States Patent
Massey

(10) Patent No.: US 7,192,009 B2
(45) Date of Patent: Mar. 20, 2007

(54) CHAIN WINCH

(76) Inventor: Navarre A. Massey, P.O. Box 1299, Fort MacLeod, Alberta (CA) T0L 0Z0

( * ) Notice: Subject to any disclaimer, the term of this patent is extended or adjusted under 35 U.S.C. 154(b) by 0 days.

(21) Appl. No.: 11/049,297

(22) Filed: Feb. 3, 2005

(65) Prior Publication Data

US 2006/0124911 A1 Jun. 15, 2006

(51) Int. Cl.
*B66F 3/00* (2006.01)

(52) U.S. Cl. ..... 254/216; 254/217; 254/220; 254/221; 410/102; 410/100; 410/103

(58) Field of Classification Search ..... 254/214, 254/216, 217, 219–223; 74/396, 505; 410/47, 410/12, 97, 100, 102, 103, 106, 110, 116
See application file for complete search history.

(56) References Cited

U.S. PATENT DOCUMENTS 1,823,760 A * 9/1931 Pierce ..... 254/217
1,868,558 A * 7/1932 Anderson ..... 254/218
4,646,805 A 3/1987 Dohmeier
6,241,215 B1 6/2001 Gersemsky et al.
6,939,095 B1 * 9/2005 Hugg ..... 410/102

FOREIGN PATENT DOCUMENTS

CA 1319674 3/1989

* cited by examiner

*Primary Examiner*—Emmanuel Marcelo
*Assistant Examiner*—Evan H. Langdon
(74) *Attorney, Agent, or Firm*—Anthony R. Lambert

(57) ABSTRACT

A chain winch comprising a slack adjustor arranged for attachment to a chain for securing loads. The chain winch has a winding shaft and cooperating slack adjustor mounted on a frame for continuous rotation of the winding shaft by the slack adjustor, and the winding shaft incorporates a chain securing element.

8 Claims, 9 Drawing Sheets

CHAIN WINCH

BACKGROUND OF THE INVENTION

Winch devices are often used to tie down loads for transportation. A winch device such as that described in the present inventor's Canadian patent no. 1,319,674 uses a worm gear drive. The advantage of this type of winch over commonly used ratchet systems is that it allows the user to set the tension more precisely compared with other commonly used ratchet systems that can only be set at broad intervals where the pawl locks into the ratchet wheel. However, it is not suitable for use with a chain.

SUMMARY OF THE INVENTION

There is provided a chain winch comprising a slack adjustor arranged for attachment to a chain for securing loads. According to an aspect of the invention, there is provided a chain winch, comprising a winding shaft and cooperating slack adjustor mounted on a frame for continuous rotation of the winding shaft by the slack adjustor, and the winding shaft incorporating a chain securing element. Further summary of the invention is found in the claims, which are incorporated here by reference.

BRIEF DESCRIPTION OF THE FIGURES

There will now be described preferred embodiments of the invention with reference to the figures by way of example, in which.

DETAILED DESCRIPTION OF PREFERRED EMBODIMENTS OF THE INVENTION

Figure 1:
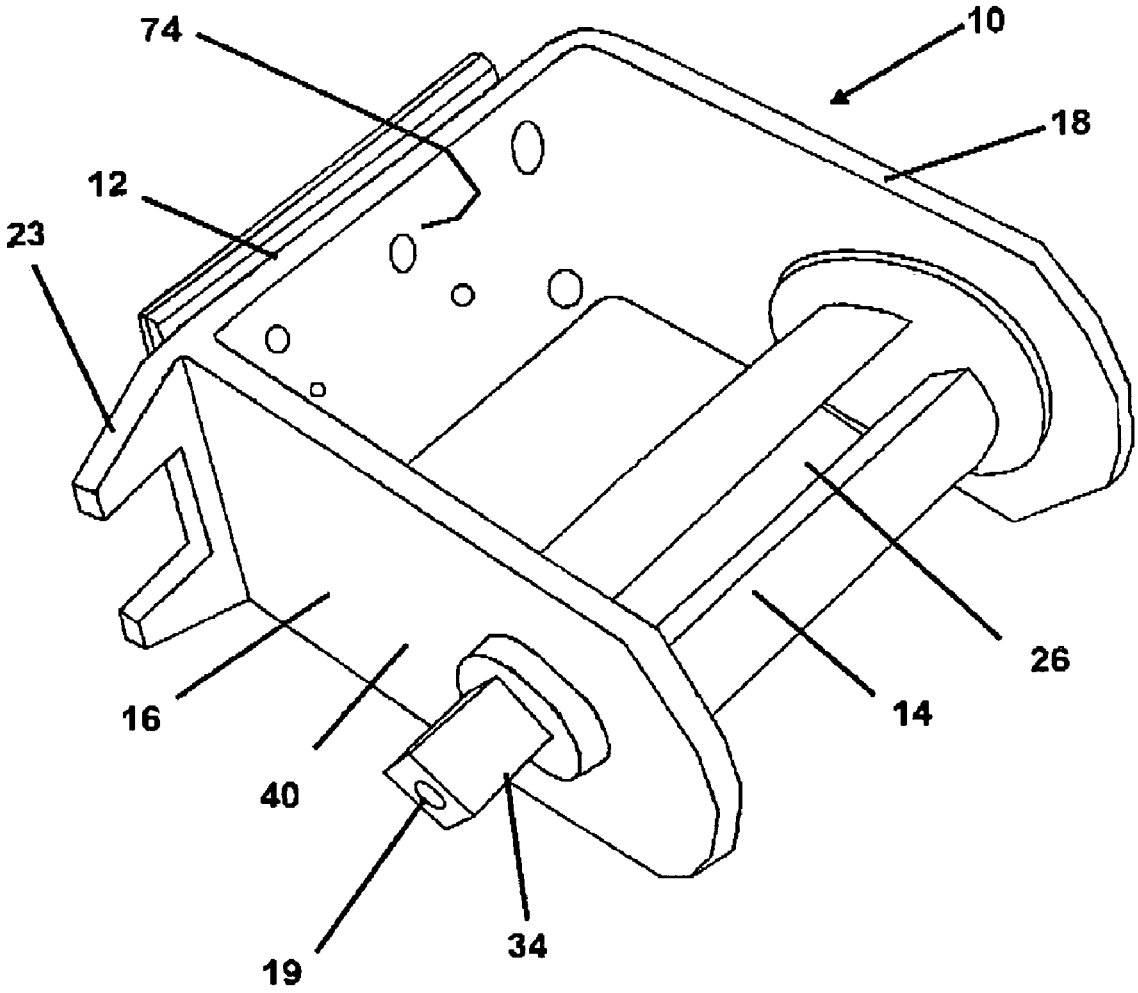
FIG. 1 shows a perspective view of a winch frame and shaft according to the invention.
Figure 2:
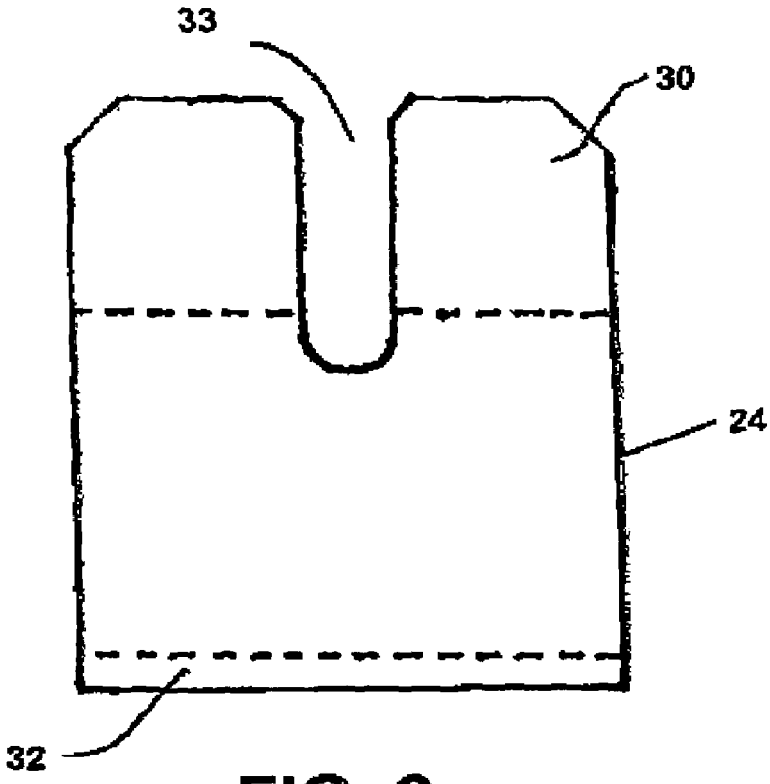
FIGS. 2 and 3 show respective side views of a chain attachment device for use with an embodiment of the invention.
Figure 3:
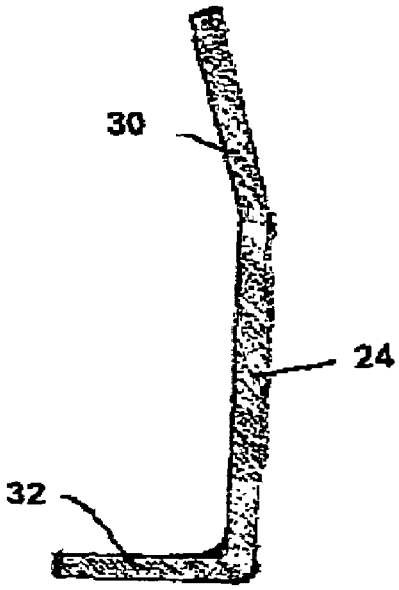
Figure 4:
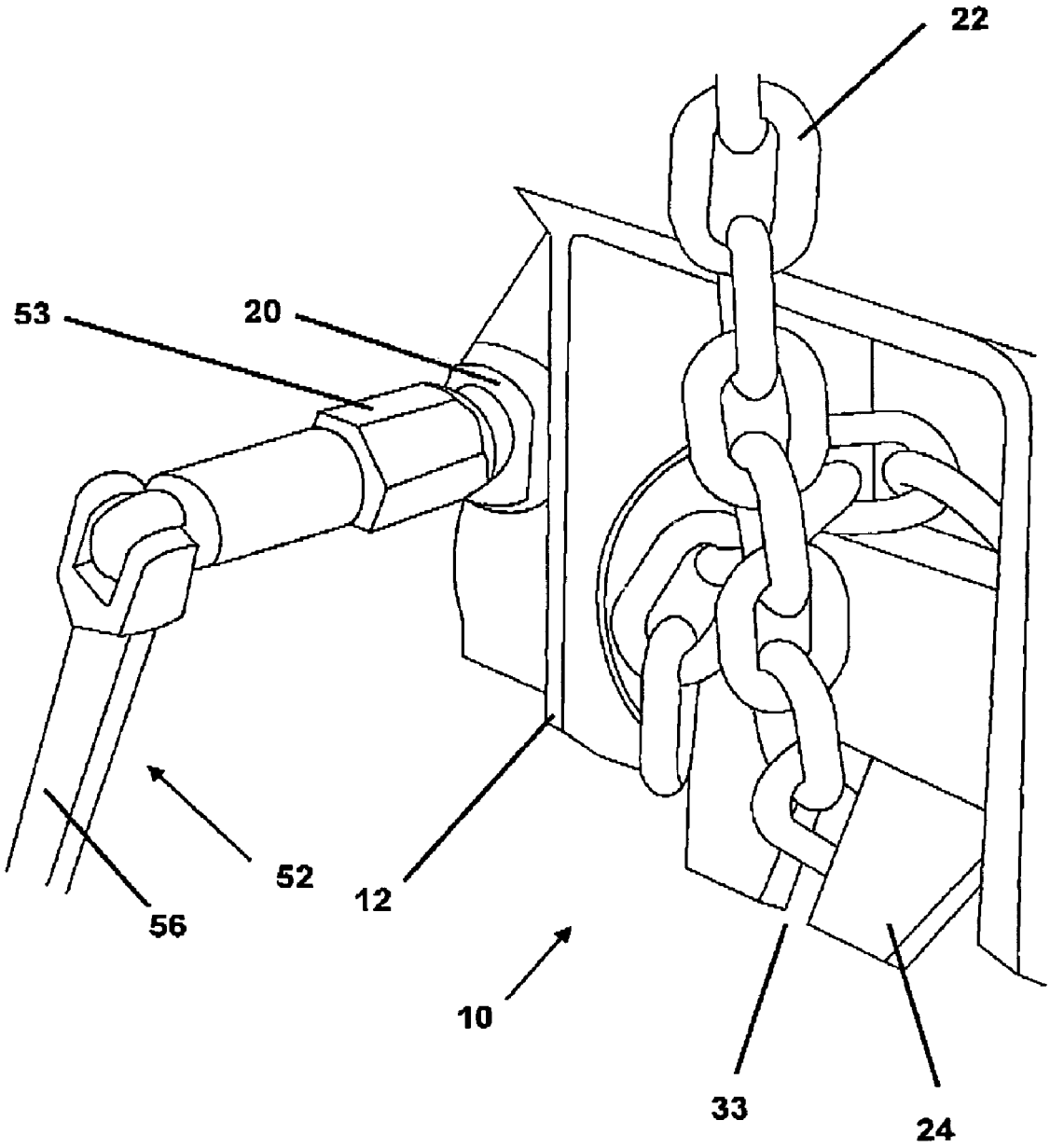
FIG. 4 is a perspective view of a chain mounted on a winch according to an embodiment of the invention.
Figure 5:
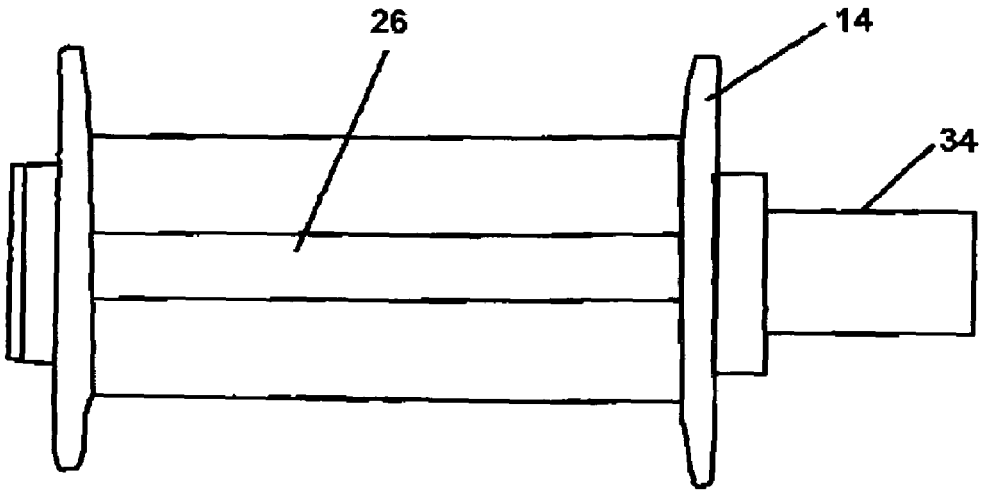
FIG. 5 is a plan view of a winding shaft for use with an embodiment of the invention.

As shown in FIGS. 1 and lA, a chain winch 10 according to an embodiment of the invention has a frame 12 on which to other components are mounted. Winding shaft 14 is held in suitable openings in the side arms 16 and 18 of the frame 12. A slack adjuster 20 is mounted on the frame 12 and interconnects with the winding shaft 14 for continuous incremental rotation of the winding shaft 14 and hence tightening of a chain 22 secured to the winding shaft 14 (FIG. 4). The winding shaft 14 incorporates a chain securing element which in the instance shown in FIGS. 1, 2 and 3 is a metal insert 24 or plate that slides into and is secured in a slot 26 of the winding shaft 14. The insert 24 may be secured in slot 26 for example by friction, and the insert 24 is adapted to catch or secure a link of a chain 22 at one end 30 and has a stop 32 at the other end for holding the insert 24 in the slot 26 of the winding shaft 14. The insert 24 maybe flat or curved as shown in FIG. 3, and has a slot 33 for receiving a link of a chain 22, which is so dimensioned to allow a chain link to pass through the slot 33 but catch the next link in the chain.

Figure 1A:
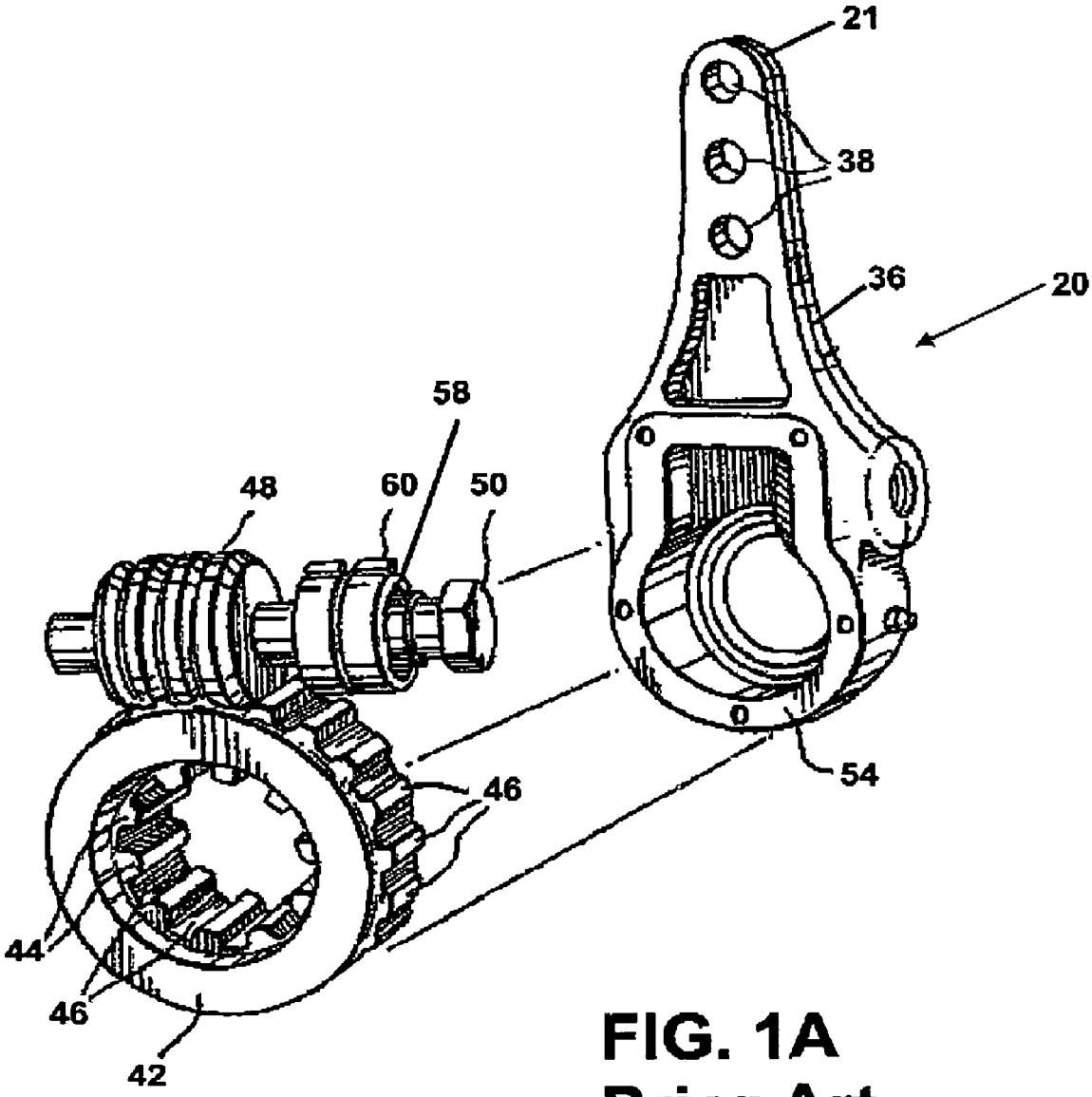
FIG. 1A Prior Art
FIG. 1A is a copy of FIG. 4 from Canadian patent no. 1,319,674, and shows a slack adjusting mechanism for use with an embodiment of the invention.

The design of the chain winch 10 allows a user to attach a chain 22 to the chain winch 10 by inserting the metal plate or insert 24 through the slot 26 that is generally used to attach straps. In the present case, the slack adjuster 20 is a Brunner™ slack adjustor and is readily commercially available. However, any of various slack adjustors may be used that provide continuous tightening. An example of a Brunner™ slack adjustor is shown in FIG. 1A and the following discussion is taken from Canadian patent no. 1,319,674, which describes the same slack adjustor. The slack adjustor 20 includes an elongated body 36 with a row of openings 38 in one end thereof. One of the openings 38 may be used in conjunction with a bolt and a nut (not shown) to attach one end of the slack adjuster 20 to one side wall 40 of the frame 12. Alternatively, the slack adjustor 20 may be secured by a strew or bolt inserted into end 19 of the spindle 34, with the elongated end 21 of the slack adjustor 20 extending between ears 23 on frame 12 to prevent rotation of the body of the slack adjustor. The static adjuster 20 includes an annular gear 42 with internal connector 44 for connecting the slack adjuster to a spindle 34 (FIG. 2) for rotating the shaft 14. The connector 44 is shown with multiple splines but could use other shapes for example to match the squat shape of spindle 34. The teeth 46 on the outer periphery of the gear 42 are engaged by a worm 48 from which projects a bolt 50. Thus, the bolt 50 is in driving connection with the worm 48. The gear 42, the worm 48 and the bolt 50 are normally housed in the larger end of the slck adjuster body 36. The bolt 50 is rotated by means of a simple crank such as a socket wrench 52 (FIGS. 1 to 3), which includes a socket 53 and a lever arm or handle 56. Rotation of the wrench 52 permits continuous tightening of the chain 22.

Preferably, the slack adjustor 20 is provided with a slip stop mechanism. The slip stop mechanism is a common feature of Brunner™ slack adjustors and prevents loosening of the slack adjustor due to tension and vibration. The slip stop may for example be a spring loaded sleeve 58 that is depressed inwardly and disengaged from the head of bolt 50 when a socket 53 is pressed onto the head of bolt 50. Upon removal of socket 53, the sleeve 58 is urged outward by a spring into engagement with the head of bolt 50. The internal bore of socket 53 preferably matches the typically hexagonal shape of the head of bolt 50. A spline 60 of the sleeve 58 engages a corresponding notch or slot in the body of slack adjustor 20 to prevent rotation of bolt 50 when the sleeve 58 is engaged with the head of the bolt 50.

Figure 6:
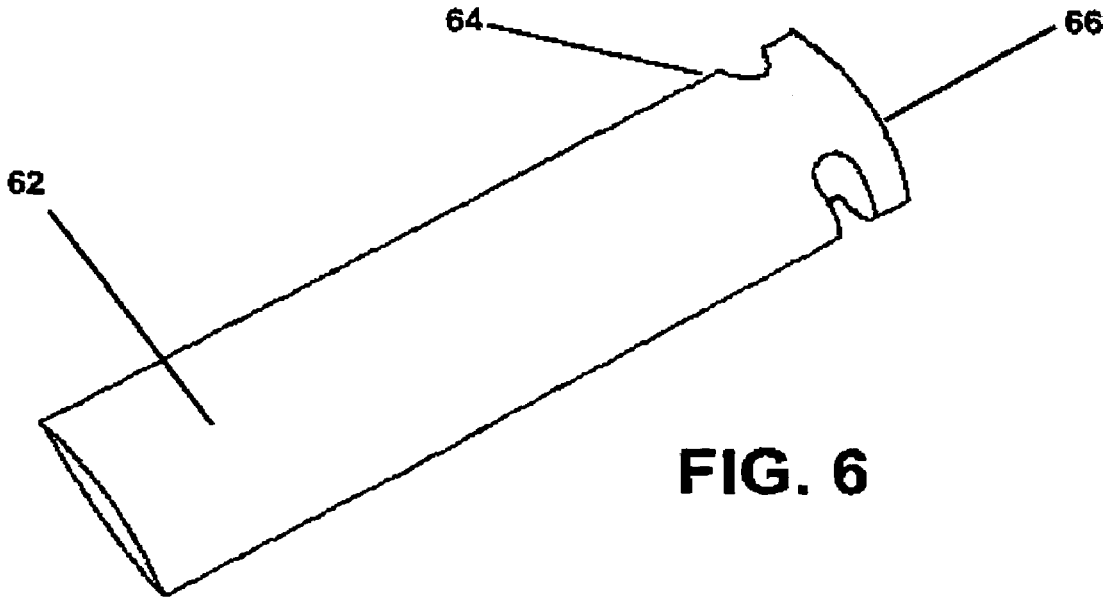
FIG. 6 shows a socket used for tightening the chain winch of an embodiment of the invention.
Figure 7:
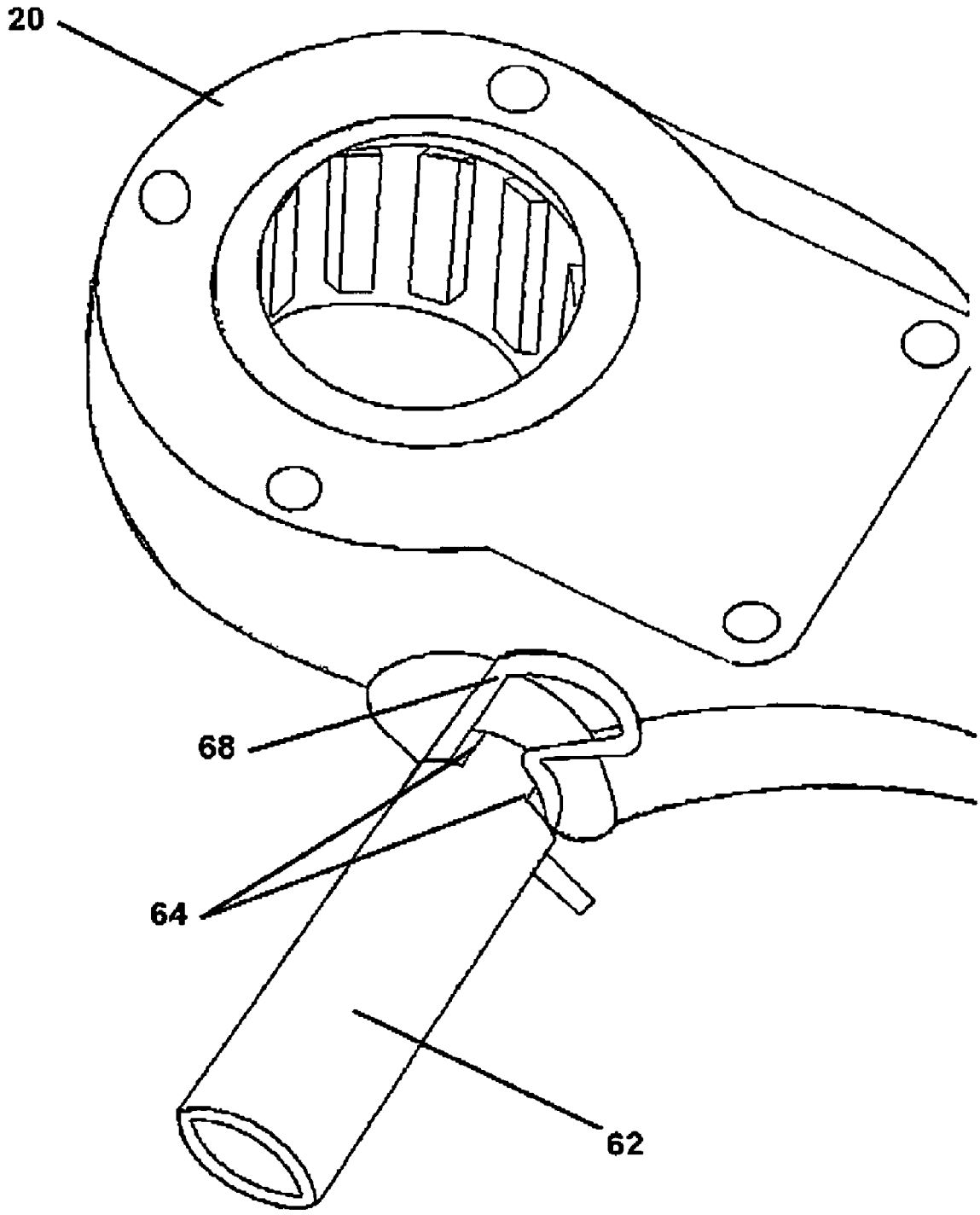
FIG. 7 shows the socket of FIG. 6 in position on a slack adjustor used with an embodiment of the invention.
Figure 8:
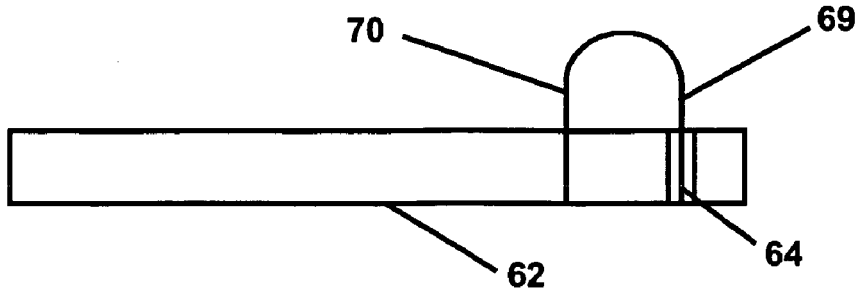
FIG. 8 shows a socket and securing clip according to an embodiment of the invention.

As shown in FIG. 6, a socket 62 used for turning the bolt 50 may be provided with parallel slots 64 machined inwardly of the end face 66 of the socket. When the socket 62 is engaged with the head of bolt 50, as shown in FIG. 7, a snap ring or clip 68 may be inserted into the slots 64 to secure the socket 62 on the head of bolt 50. In this manner, the wrench 52 may more easily be held in place on the bolt 50 against the pressure of spring loaded sleeve 58 and thus is more easily operated with one hand. In a further version of a clip 69, shown in FIG. 8, the clip 69 has one end forming the snap ring and the other end may be provided with a retainer portion 70 that clips or is otherwise tied or secured to the body of socket 62 to hold the clip 69 readily available for use.

Figure 9:
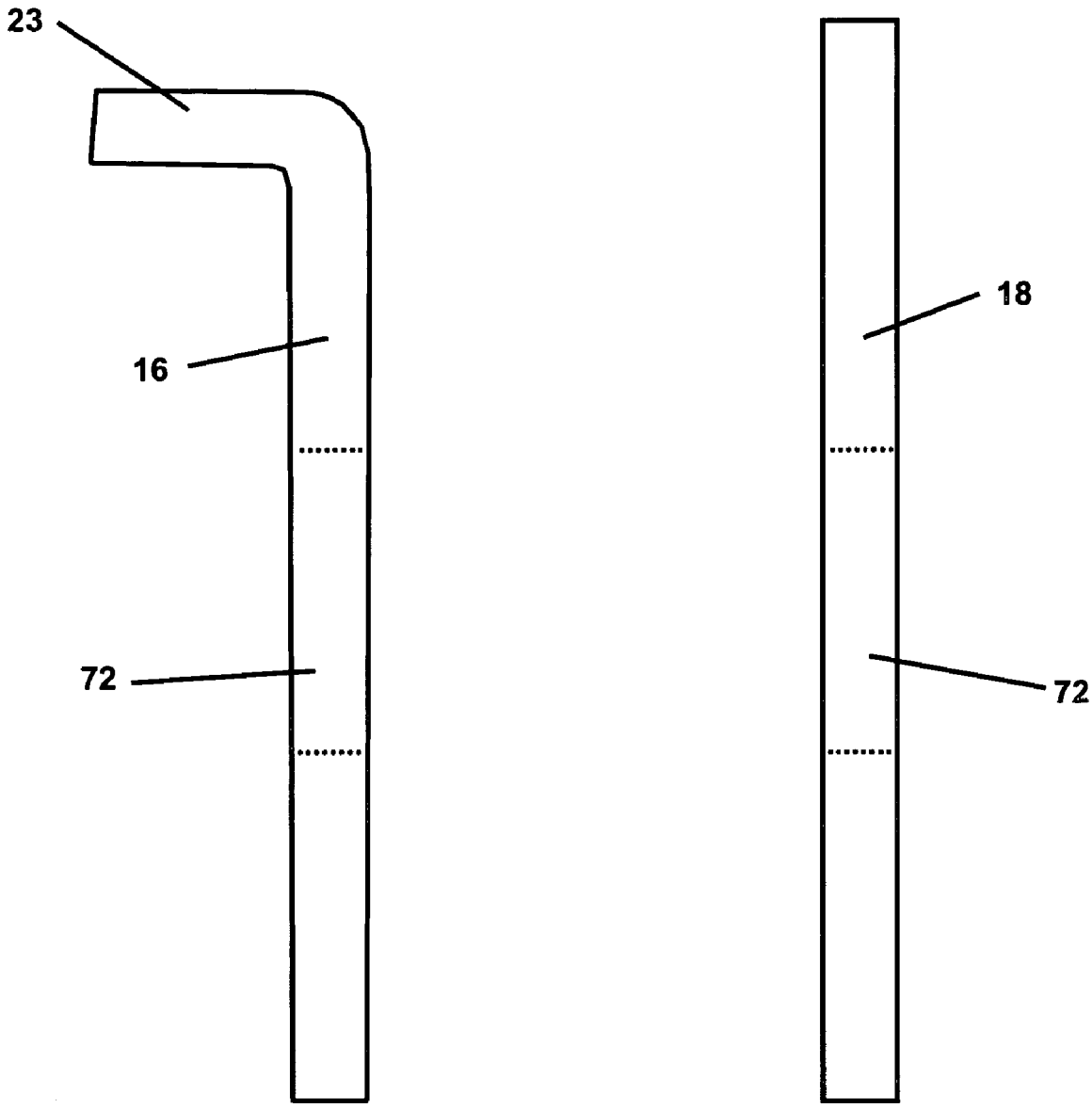
FIGS. 9–11 show different frame designs for mounting the frame on a vehicle.
Figure 10:
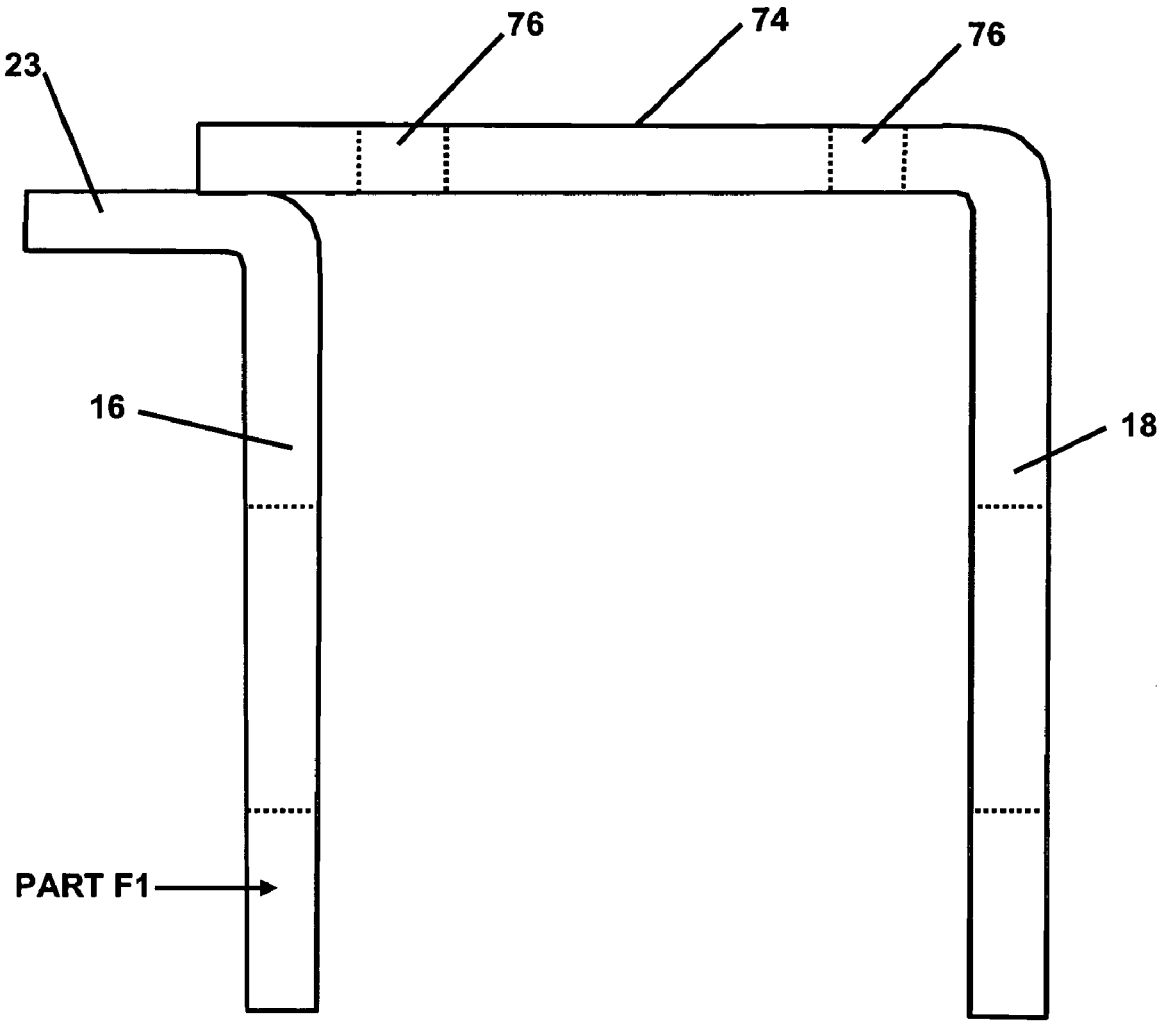
Figure 11:
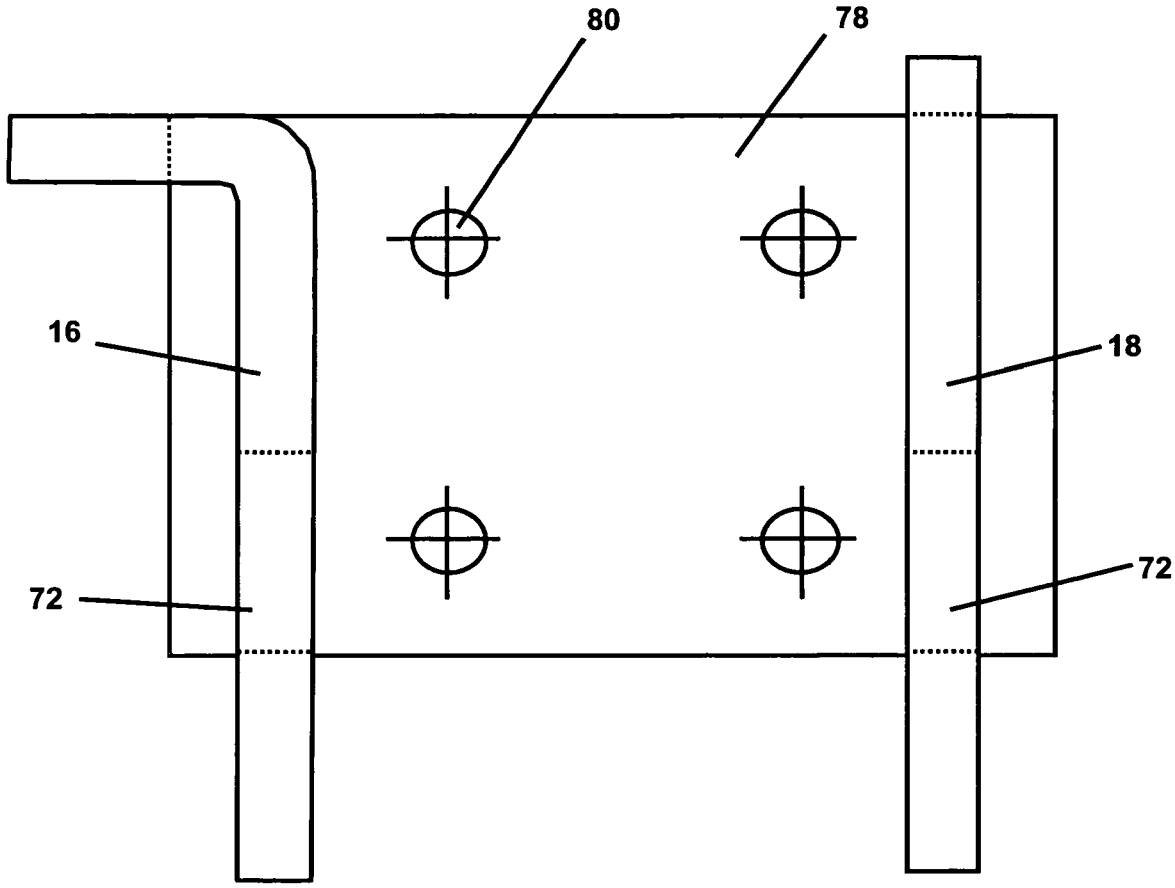

Various ways of attaching the frame 12 to a vehicle may be used. As shown in FIG. 9, side arms 16 and 18 of the frame 12 may be welded directly to the vehicle with openings 72 receiving the winding shaft 14. In this case, the upper plate 74 (FIG. 1) is not required. In another example, a bottom mount example shown in FIG. 10, and corresponding to FIG. 1, the arm 18 includes a portion 74 with openings 76 for bolting the frame 12 under a portion of a vehicle. In a further side mount example shown in FIG. 11, a plate 78 welded to arms 16 and 18 is used to bolt the frame 12 to a side of a vehicle using openings 80 to receive the bolts.

Slack adjustor 20 may be replaced with other designs that provide continuous slack adjustment and tightening. The continuous tightening is provided by the worm and screw feature of the slack adjustor 20. The lever arm or wrench 52 may rotate the worm to any desired level of tightening. Chain winch 10 may be attached to the underside, top or back of a body with bolts or welds. The chain winch 10 may also be mounted on rails as is known in the art. Trailers or other bodies that incorporate winches for securing loads or other purposes may be retrofitted with winch device 10 by installing it opposite the existing winch, replacing the existing winch or, if the existing winch has an appropriate slot 26, by inserting metal insert 24 into the slot 26.

In a preferred embodiment, the winding shaft is made from cast iron 80-55-06 to enable use with chain. The preferred embodiment has been conceived in three variations: a bottom mount style, side mount style and a two-piece weld-on style.

Immaterial modifications may be made to the disclosed embodiments without departing from the invention. In the claims, the word comprising and the indefinite article "a" do not exclude other elements being present.

What is claimed is:

1. A chain winch, comprising:

a frame;

a winding shaft mounted in the frame;

a slack adjuster mounted on the frame and interconnecting with the winding shaft through a gear reducer for rotation of the winding shaft by the slack adjustor;

the winding shaft incorporating a chain securing element; and the chain securing element comprising an insert retained in a slot in the winding shaft, the insert being adapted to secure a link of a chain at one end and having a stop at the other end for holding the insert in the slot of the winding shaft, the insert including a slot for receiving a link of a chain.

2. The chain winch of claim 1 in which the slack adjustor is a worm and screw slack adjustor.

3. The chain winch of claim 2 in which the slack adjustor incorporates a braking mechanism.

4. The chain winch of claim 3 in which the braking mechanism for the slack adjustor comprises a head of a bolt for turning the worm and a spring loaded sleeve That acts as a stop for the bolt in an extended position.

5. A chain winch, comprising:

a frame;

a winding shaft mounted in the frame;

a slot passing through the winding shaft within the frame;

a slack adjuster mounted on the frame and interconnecting wit the winding shaft for rotation of the winding shaft by the slack adjustor; and an insert in the slot for securing a chain, the insert being adapted to secure a link of a chain at one end and having a stop at the other end for holding the insert in the slot of the winding shaft, the insert including a slot for receiving a link of a chain.

6. The chain winch of claim 5 in which the slack adjustor is a worm and screw slack adjustor.

7. The chain winch of claim 6 in which the slack adjustor incorporates a braking mechanism.

8. The chain winch of claim 7 in which the braking mechanism for the slack adjustor comprises a head of a bolt for turning the worm and a spring loaded sleeve that acts as a stop for the bolt in an extended position.

* * * * *